US008602908B2

(12) United States Patent
Takeuchi

(10) Patent No.: US 8,602,908 B2
(45) Date of Patent: Dec. 10, 2013

(54) GOLF CLUB SHAFT

(75) Inventor: Hiroyuki Takeuchi, Kobe (JP)

(73) Assignee: SRI Sports Limited, Hyogo (JP)

( * ) Notice: Subject to any disclaimer, the term of this patent is extended or adjusted under 35 U.S.C. 154(b) by 394 days.

(21) Appl. No.: 12/762,646

(22) Filed: Apr. 19, 2010

(65) Prior Publication Data

US 2010/0285897 A1 Nov. 11, 2010

(30) Foreign Application Priority Data

May 11, 2009 (JP) ..... 2009-114349

(51) Int. Cl.
*A63B 53/10* (2006.01)

(52) U.S. Cl.
USPC ..... 473/319

(58) Field of Classification Search
USPC ..... 473/316–320
See application file for complete search history.

(56) References Cited

U.S. PATENT DOCUMENTS

| | | | | |
|---|---|---|---|---|
| 4,000,896 | A * | 1/1977 | Lauraitis | 473/319 |
| 4,132,579 | A * | 1/1979 | VanAuken | 156/189 |
| 6,056,648 | A * | 5/2000 | Kusumoto et al. | 473/319 |
| 6,106,413 | A * | 8/2000 | Kusumoto | 473/319 |
| 6,306,047 | B1 * | 10/2001 | Kusumoto | 473/319 |
| 6,524,195 | B1 * | 2/2003 | Kusumoto | 473/319 |
| 6,905,422 | B2 * | 6/2005 | Atsumi et al. | 473/319 |
| 7,361,098 | B2 * | 4/2008 | Oyama | 473/319 |
| 7,517,288 | B2 * | 4/2009 | Kumamoto | 473/319 |
| 7,967,698 | B2 * | 6/2011 | Kato | 473/319 |
| 2004/0009827 | A1 | 1/2004 | Oyama | |

FOREIGN PATENT DOCUMENTS

| | | | |
|---|---|---|---|
| JP | 2002-233598 | A | 8/2002 |
| JP | 2004-33667 | A | 2/2004 |
| JP | 2004-057731 | A | 2/2004 |
| JP | 2005-270343 | A | 10/2005 |

OTHER PUBLICATIONS

Machine-Generated English Translation of JP 2005-270343, which was published Oct. 6, 2005.
Office Action for corresponding Japanese Application No. 2009-114349 dated May 17, 2011 with English Language Translation.

* cited by examiner

*Primary Examiner* — Stephen L. Blau
(74) *Attorney, Agent, or Firm* — Birch, Stewart, Kolasch & Birch, LLP

(57) ABSTRACT

A shaft of the present invention has a tip reinforcing layer. A prepreg s9 for the tip reinforcing layer has a portion having a larger circumferential direction width Ws toward a tip side. The prepreg s9 for the tip reinforcing layer has a thickness Pt of 0.06 mm or greater and 0.12 mm or less. An edge Ds of the tip reinforcing layer extends in an axial direction of the shaft while circulating in a circumferential direction of the shaft. An average value Ha of the five heights h11 to h15 is equal to or less than 0.03 mm.

17 Claims, 8 Drawing Sheets

GOLF CLUB SHAFT

This application claims priority on Patent Application No. 2009-114349 filed in JAPAN on May 11, 2009, the entire contents of which are hereby incorporated by reference.

BACKGROUND OF THE INVENTION

1. Field of the Invention

The present invention relates to a golf club shaft. More particularly, the present invention relates to a golf club shaft made of a fiber reinforced resin.

2. Description of the Related Art

A golf club shaft is divided broadly into a so-called steel shaft and carbon shaft. The carbon shaft is widely used in respects of lightness, a high degree of freedom of design, or the like.

The so-called carbon shaft is made of a fiber reinforced resin. As a manufacturing method of the carbon shaft, a sheet winding method is well known. In the manufacturing method, a sheet-shaped prepreg is wound around a mandrel (cored bar), further a wrapping tape is wound, and then the prepreg is heated to cure the prepreg.

The wrapping tape is spirally wound. After the curing step, the wrapping tape is removed. A large number of irregularities formed by the wrapping tape remain on the surface of a cured tubular body. Surface polishing is applied in order to smooth the irregularities as described in Japanese Patent Application Laid-Open No. 2004-57731.

A head is attached to a tip part of a shaft. A stress in hitting is apt to be concentrated on the tip part of the shaft. In a shaft disclosed in Japanese Patent Application Laid-Open No. 2002-233598, a prepreg for tip reinforcing which has a right triangle shape is used. The prepreg for tip reinforcing is provided on an innermost layer.

SUMMARY OF THE INVENTION

When the triangular prepreg for tip reinforcing is wound, an edge of the prepreg is spirally disposed. The edge of the prepreg forms a level difference. The level difference is caused by the thickness of the prepreg. The height of the level difference is equal to the thickness of the prepreg.

The height of the level difference is reduced by applying a polishing step. Since the level difference is spirally dispersed, the level difference is dispersed in an axial direction of the shaft. Therefore, the influence of the level difference on the strength of the shaft is considered to be negligibly low. However, the present inventors found that the spiral level difference affects the strength of the shaft.

It is an object of the present invention to provide a golf club shaft having a tip part having a high strength.

A golf club shaft of the present invention is formed by curing a wound prepreg. The golf club shaft includes: a main body layer; and a tip reinforcing layer provided on an outermost layer. The prepreg for the tip reinforcing layer has a portion having a larger circumferential direction width toward a tip side. The prepreg for the tip reinforcing layer has a thickness Pt of 0.06 mm or greater and 0.12 mm or less. An edge of the tip reinforcing layer extends spirally. The golf club shaft is subjected to surface polishing so that a height h1 of a level difference formed by the edge of the tip reinforcing layer satisfies the following item (a).

(a) When the height h1 at a position placed apart from a tip by 60 mm is defined as h11; the height h1 at a position placed apart from the tip by 120 mm is defined as h12; the height h1 at a position placed apart from the tip by 180 mm is defined as h13; the height h1 at a position placed apart from the tip by 240 mm is defined as h14; and the height h1 at a position placed apart from the tip by 300 mm is defined as h15, an average value Ha of the heights h11 to h15 at the five positions is equal to or less than 0.03 mm.

Preferably, the golf club shaft is subjected to surface polishing so as to satisfy the item (a) and the following item (b).

(b) A ratio (Ha/Pt) is equal to or less than 0.5.

A golf club shaft of the other respect of the present invention is formed by curing a wound prepreg. The golf club shaft includes: a main body layer; and a tip reinforcing layer provided on an outermost layer. The prepreg for the tip reinforcing layer has a portion having a larger circumferential direction width toward a tip side. The prepreg for the tip reinforcing layer has a thickness Pt of 0.06 mm or greater and 0.12 mm or less. An edge of the tip reinforcing layer extends spirally. The golf club shaft is subjected to surface polishing so that a height h1 of a level difference formed by the edge of the tip reinforcing layer satisfies the following item (b).

(b) When the height h1 at a position placed apart from a tip by 60 mm is defined as h11; the height h1 at a position placed apart from the tip by 120 mm is defined as h12; the height h1 at a position placed apart from the tip by 180 mm is defined as h13; the height h1 at a position placed apart from the tip by 240 mm is defined as h14; the height h1 at a position placed apart from the tip by 300 mm is defined as h15; and an average value of the heights h11 to h15 at the five positions is defined as Ha, a ratio (Ha/Pt) is equal to or less than 0.5.

Preferably, the main body layer has a full length layer provided over a full length of the shaft. Preferably, when a layer positioned on the outermost side in the full length layer is defined as a full length outermost layer, the full length outermost layer has an exposure layer exposed to an outer surface of the shaft. Preferably, when a thickness of the exposure layer before the surface polishing is defined as Qt1 (mm), and an average thickness of the exposure layer after the surface polishing is defined as Qt2 (mm), a ratio (Qt2/Qt1) is equal to or greater than 0.6.

The present invention can enhance the strength of the tip part of the golf club shaft using the prepreg for tip reinforcing.

DESCRIPTION OF THE PREFERRED EMBODIMENTS

The present invention will be described below in detail based on preferred embodiments with reference to the drawings.

Figure 1:
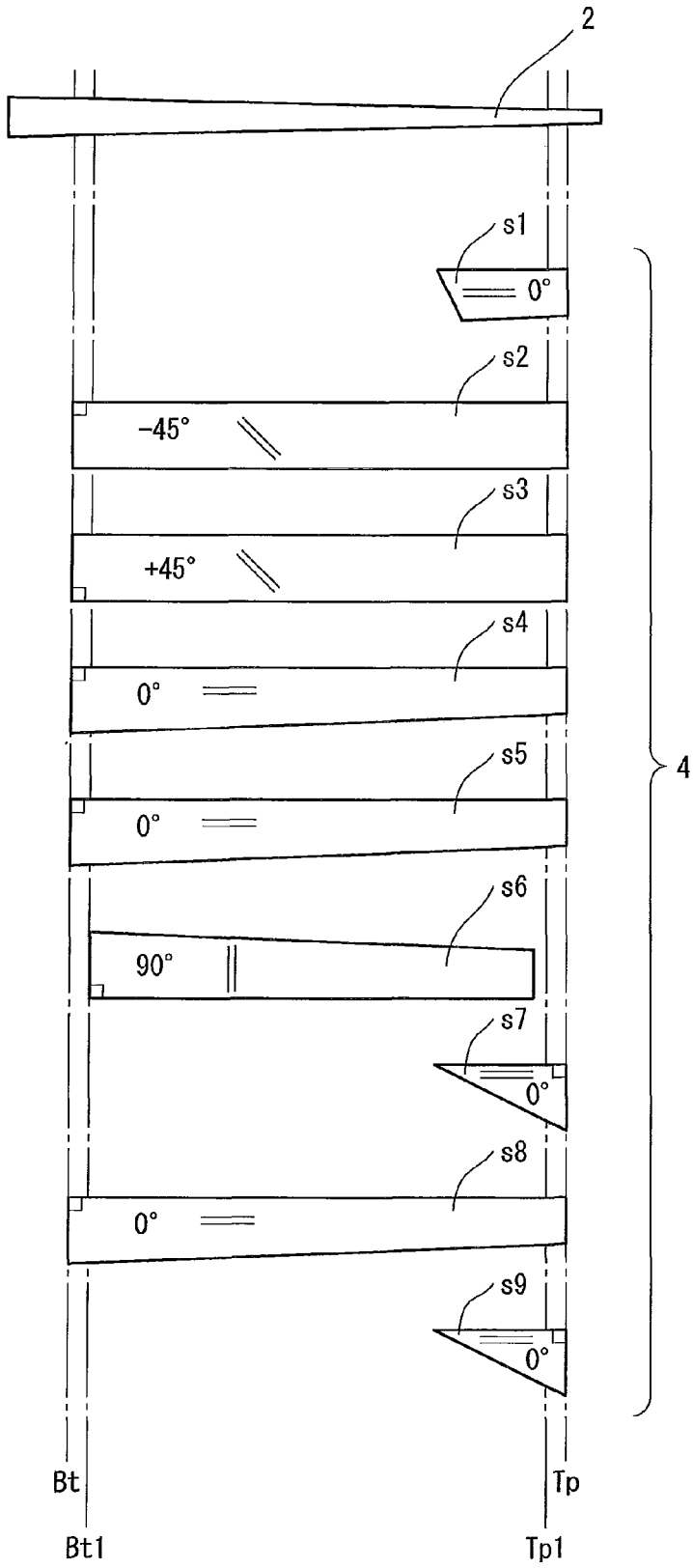
FIG. 1 is a view showing a mandrel and a prepreg which can be used in an embodiment according to the present invention.

FIG. 1 is a view for explaining a manufacturing method of a golf club shaft according to an embodiment of the present invention. In the manufacturing method, first of all, a mandrel 2 and a prepreg 4 are prepared. The mandrel 2 is also referred to as a cored bar. A typical material of the mandrel 2 is a metal such as steel. A central axis of the mandrel 2 is an almost straight line. A sectional shape of the mandrel 2 is circular. The mandrel 2 has a taper. By the taper, the mandrel 2 becomes thinner toward a tip. The mandrel 2 may be partially parallel. In other words, the mandrel 2 may partially include a portion having a constant diameter.

The mandrel 2 forms a hollow portion of the shaft finally obtained. A shape of the hollow portion of the shaft is determined by the shape of the mandrel 2. As will be described below, the mandrel 2 is pulled out at a subsequent step. In order to easily carry out the pull-out, it is preferable that a surface of the mandrel 2 is coated with a lubricant.

In the manufacturing method, first of all, a step of winding the prepreg 4 around a mandrel is carried out. The step will be hereinafter referred to as a winding step.

Prior to the winding step, the prepreg 4 is prepared. The prepreg 4 is sheet-shaped. The prepreg 4 includes a fiber and a matrix resin. The fiber is a carbon fiber. The carbon fiber of the prepreg 4 is oriented in one direction. The fiber may be a fiber other than the carbon fiber. In respect of obtaining a shaft having a high strength and a light weight, the carbon fiber is preferable. The matrix resin of the prepreg 4 is not completely cured. Accordingly, the prepreg 4 has a flexibility. The flexibility permits the wind of the prepreg 4 around the mandrel 2. The matrix resin is not restricted but an epoxy resin is preferred.

Before the winding step, the prepreg 4 is cut to have a desirable shape. In the embodiment shown in FIG. 1, nine prepregs 4 are used. In the embodiment of FIG. 1, sheets s1 to s9 are shown as an example of the prepreg 4 which is cut. The prepreg 4 includes the sheets s2 and s3 for angle layers, the sheets s1, s4, s5, s7, s8, and s9 for straight layers and the sheet s6 for hoop layer. The prepreg 4 includes the full length sheets s2, s3, s4, s5, and s8 provided over a full length of the shaft, and the partial sheets s1, s6, s7, and s9 provided in a part in a longitudinal direction of the shaft. The specification of the prepreg 4 is not restricted. A shape, a thickness, a fiber type, a fiber content, or the like of the prepreg 4 are not restricted.

At the winding step, the sheets s1 to s9 are sequentially wound around the mandrel 2. Prior to the wind, the sheet s2 is laminated on the sheet s3, which is not shown. A laminated body formed by the lamination is wound around the mandrel 2. In the lamination, the sheet s3 is turned over. By the turnover, a fiber of the sheet s2 and that of the sheet s3 are oriented in reverse directions to each other. In FIG. 1, angles described in the sheets s1 to s9 indicate an angle formed by an axial direction of the shaft and an orientation of the fiber.

For example, the sheets s1 to s9 are manually wound. A winding machine (which is also referred to as a rolling machine) may be used. An intermediate formed body 6 is obtained through the winding step. The intermediate formed body 6 is constituted by the wound prepreg 4. A section of the intermediate formed body 6 is formed by a whorl-like layer. The layer is formed by the plurality of prepregs 4.

Next, a tape winding step is executed. At the tape winding step, a wrapping tape is wound around an outer peripheral surface of the intermediate formed body 6. A tape made of a resin is used as the wrapping tape. The wrapping tape is spirally wound, which is not shown. The wrapping tape is wound around the intermediate formed body 6 without a gap.

The wrapping tape is wound with an application of a tension. By the tension, the intermediate formed body 6 is fastened with the wrapping tape.

After the winding step, a curing step is carried out. At the curing step, the intermediate formed body 6 around which the wrapping tape is wound is heated. The matrix resin is cured by the heating.

After the curing step, the mandrel 2 is pulled out and the wrapping tape is removed to obtain a cured tubular body. Hereinafter, the cured tubular body is also referred to as a tube stock.

Next, the both ends of the tube stock are cut. More specifically, the tip part and butt part of the tube stock are cut. Hereinafter, the cutting is also referred to as cutting of both ends. The cutting of both ends flattens the end faces of the tip and butt. In FIG. 1, the tip of the shaft after the cutting of both ends is represented by Tp1. The butt of the shaft after the cutting of both ends is represented by Bt1.

The both ends may not be cut. When the both ends are not cut, a tip Tp of the tube stock is coincident with the tip Tp1 of the shaft. When both of the ends are not cut, a butt Bt of the tube stock is coincident with the butt Bt1 of the shaft.

Next, a surface polishing step (merely referred to as a polishing step) is carried out. The marks of the wrapping tape remain on the surface of the tube stock. The marks are a large number of irregularities. The irregularities are smoothed in the process of the surface polishing. The surface polishing step will be described below in detail.

Usually, coating is carried out after the surface polishing step. A shaft to be a final product is accomplished by the coating.

The outer diameter of the tip Tp1 of the shaft is smaller than the outer diameter of the butt Bt1. The outer diameter of the shaft is increased from the tip Tp1 toward the butt Bt1. The shaft may have a portion having an outer diameter increased from the tip Tp1 side toward the butt Bt1 side and a portion having a constant outer diameter.

The shaft obtained in the embodiment has a tip reinforcing layer provided on an outermost layer. The tip reinforcing layer is formed by curing the prepreg sheet s9. The sheet s9 of the outermost layer is a prepreg for the tip reinforcing layer. A tip side end of the prepreg for the tip reinforcing layer is placed at the tip Tp of the tube stock. A tip side end of the tip reinforcing layer is placed at the tip Tp1 of the shaft.

Figure 2:
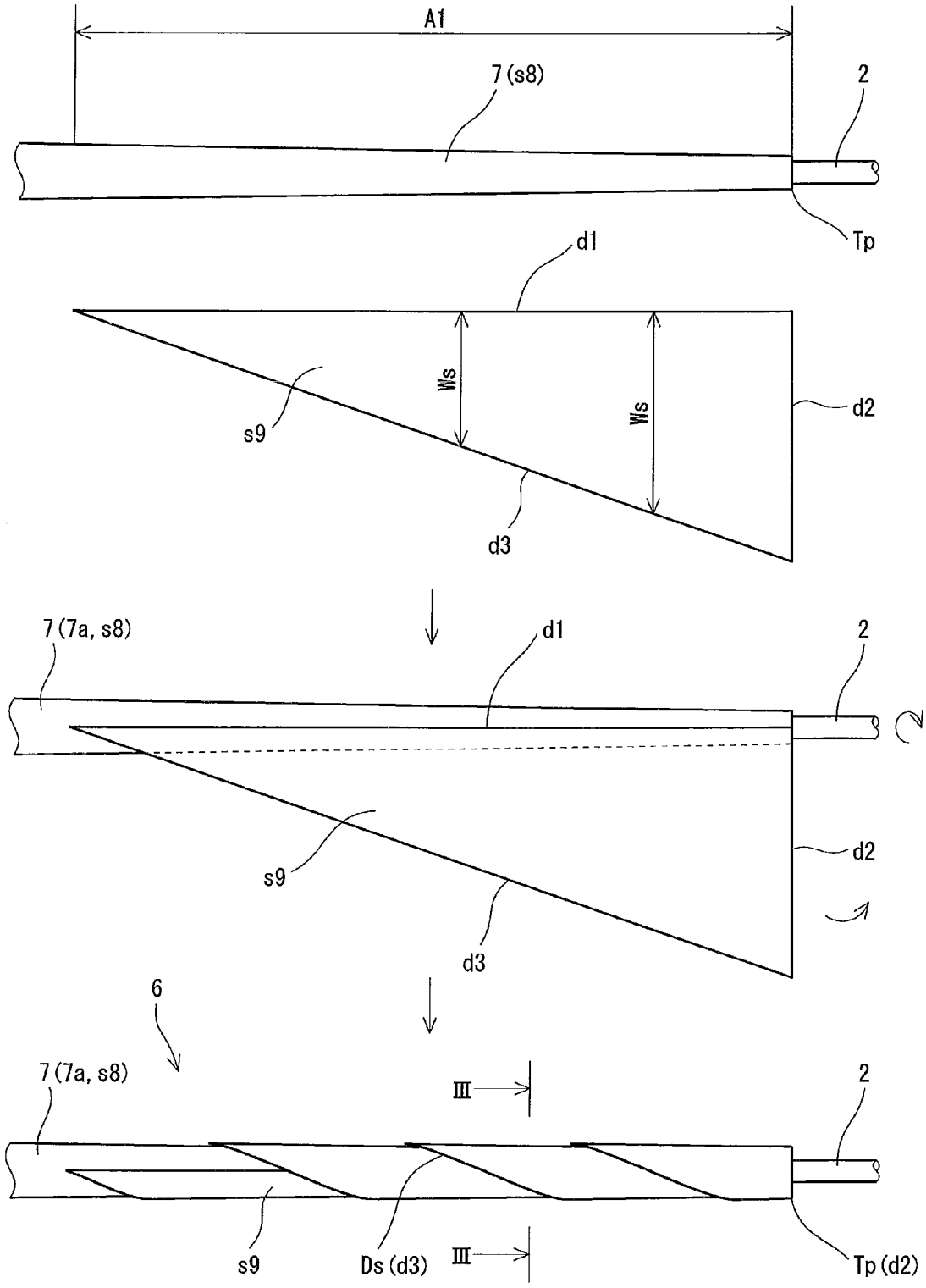
FIG. 2 is a view showing a step of winding a prepreg for a tip reinforcing layer.

FIG. 2 is a view showing a state in which the prepreg s9 for the tip reinforcing layer of the outermost layer is wound at the winding step. The sheet s9 is a sheet finally wound. A main wound body 7 is formed by winding the sheets s1 to s8 around the mandrel 2 (see FIG. 2). In the application, a wound body obtained by winding a prepreg other than the prepreg s9 for the tip reinforcing layer is referred to as the main wound body 7. A main body layer of the shaft is obtained by curing the main wound body 7.

The main body layer has a full length layer. The full length layer is a layer provided over a full length of the shaft. In other words, the full length layer is a layer extending from a tip end to butt end of the shaft. The full length layer is constituted by full length sheets s2, s3, s4, s5, and s8 described above. More specifically, a layer obtained by curing the full length sheet s2, s3, s4, s5, and s8 is the full length layer. In the embodiment, a plurality of full length layers are used. A single full length layer may be used.

A layer positioned on the outermost side in the full length layer is referred to as a full length outermost layer. In the embodiment, a layer constituted by the full length sheet s8 is the full length outermost layer. When the full length sheet s8 of the outermost side is constituted by a plurality of layers (plural ply), the outermost layer of the plurality of layers is the full length outermost layer.

The full length outermost layer has an exposure layer exposed to an outer surface of the shaft. The exposure layer is formed by an outermost layer 7*a* of the main wound body 7. The cured outermost layer 7*a* is the exposure layer. After the outermost layer 7*a* is cured, the outermost layer 7*a* is polished at the surface polishing step. A portion of the full length outermost layer covered with the tip reinforcing layer (prepreg s9) is not the exposure layer.

As shown in FIGS. 1 and 2, the shape of the prepreg s9 for the tip reinforcing layer is a triangle. The prepreg s9 for the tip reinforcing layer has a larger circumferential direction width Ws toward a tip side (see FIG. 2). The circumferential direction means a circumferential direction of the shaft.

The main wound body 7 has a shape made thinner toward the tip side in at least a part of a setting range A1 (see FIG. 2) of the tip reinforcing layer (prepreg s9). The main wound body 7 has a shape made thinner toward the tip side in the setting range A1 of the tip reinforcing layer. The main wound body 7 has a shape made thinner toward the tip side in the whole setting range A1 of the tip reinforcing layer. The main body layer of the shaft is obtained by curing the main wound body 7. Therefore, the shape of the main body layer of the shaft is almost equal to that of the main wound body 7 except for the influence of the surface polishing. The main body layer of the shaft according to the embodiment has a shape made thinner toward the tip side in at least a part of the setting range A1 of the tip reinforcing layer. The main body layer of the shaft according to the embodiment has a shape made thinner toward the tip side in the setting range A1 of the tip reinforcing layer. The main body layer of the shaft of the embodiment is made thinner toward the tip side in the whole setting range A1 of the tip reinforcing layer.

The main wound body 7 may have a portion having a constant outer diameter in the setting range A1. The main body layer of the shaft may have a portion having a constant outer diameter in the setting range A1.

The prepreg s9 for the tip reinforcing layer is wound around the main wound body 7.

Since the prepreg s9 has the larger circumferential direction width Ws toward the tip side, the number of winds of the prepreg s9 is greater toward the tip side. In other words, the total thickness of the wound prepreg s9 is thicker toward the tip Tp side. A thickness distribution of the prepreg s9 is thicker toward the tip Tp. By contrast, the outer diameter of the main wound body 7 is smaller toward the tip Tp. The outer diameter of the intermediate formed body 6 after the prepreg s9 is wound is almost constant in the setting range A1 of the prepreg s9 due to the relationship between the prepreg s9 and the main wound body 7. In other words, the size and shape of the prepreg s9 are determined so that the average outer diameter of the intermediate formed body 6 in the setting range A1 of the prepreg s9 is constant. In this case, the tip part of the shaft can be reinforced, and the tip part of the shaft can be formed into a parallel shape. The parallel shape means that the outer diameter is constant.

The shape of the prepreg s9 of the embodiment is set to a right triangle shape. The prepreg s9 has a first side d1 and a second side d2 orthogonal to each other, and an oblique side d3. In the wind of the prepreg s9, first of all, the first side d1 is disposed in an axial direction of the main wound body 7 (see mid diagrams of FIG. 2). At this time, the second side d2 is disposed on the tip Tp side. Next, the prepreg s9 is wound by rotating the mandrel 2. A state of the wound prepreg s9 is shown in a lower diagram of FIG. 2. As shown in FIG. 2, the oblique side d3 is spirally wound. In other words, an edge (oblique side d3) of the prepreg s9 extends in the axial direction of the shaft while circulating in the circumferential direction of the shaft.

The shape of the prepreg s9 for the tip reinforcing layer is not restricted to the right triangle. The other examples of the shape include an isosceles triangle and a trapezoid. In respects of the ease of wind and the ease of design, the right triangle is preferred. When the right triangle is set, the waste of the material of the prepreg s9 is minimalized. Also in the respect, the right triangle is preferred.

Figure 3:
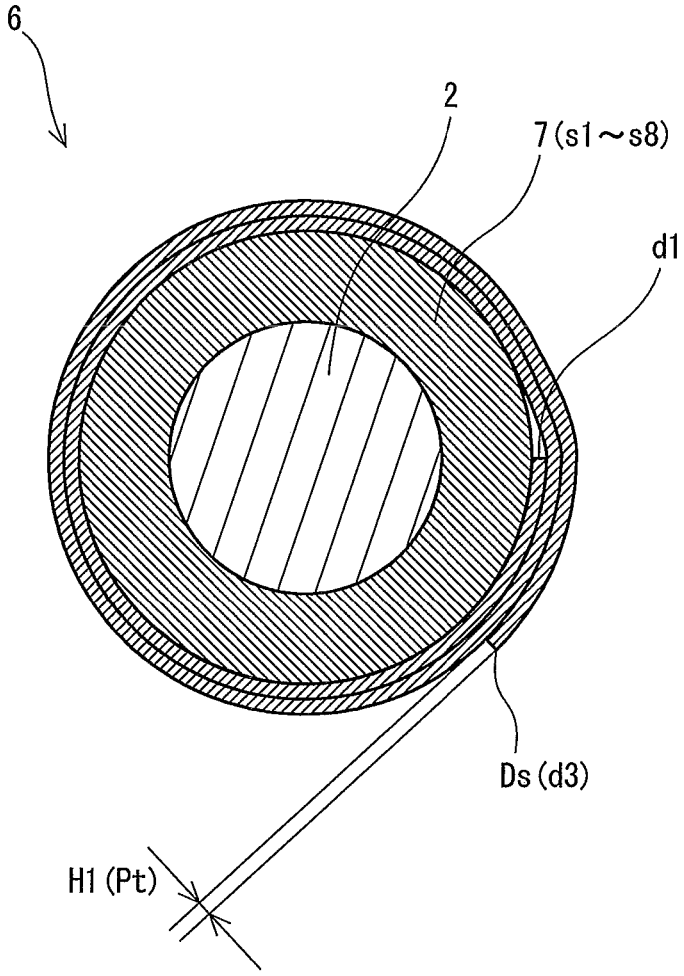
FIG. 3 is a sectional view taken along a line III-III in FIG. 2.

FIG. 3 is a sectional view taken along a line III-III in FIG. 2. Actually, the main wound body 7 is constituted by a large number of layers. However, in FIG. 3, for the purpose of simplification, the main wound body 7 is shown as a single layer. In FIG. 3, the thickness of the prepreg s9 is larger than the actual state for the purpose of the plain drawing.

The prepreg s9 is placed on an outermost layer in the intermediate formed body 6. Therefore, the oblique side d3 forms a level difference Ds on a surface of the intermediate formed body 6 (see FIG. 3). More specifically, the edge of the prepreg s9 forms the level difference Ds. A height H1 of the level difference Ds is equal to a thickness Pt of the prepreg s9 for the tip reinforcing layer.

The intermediate formed body 6 becomes a tube stock after the curing step. The level difference Ds remains even in the cured tube stock.

At the surface polishing step, the height H1 of the level difference Ds is reduced to be the height h1 (the illustration is omitted). It was believed that the influence of the level difference Ds on the strength of the shaft is not problematic since the level difference Ds is dispersed in the axial direction of the shaft. However, the strength of the shaft was found to be enhanced by reducing the level difference Ds.

Figure 4:
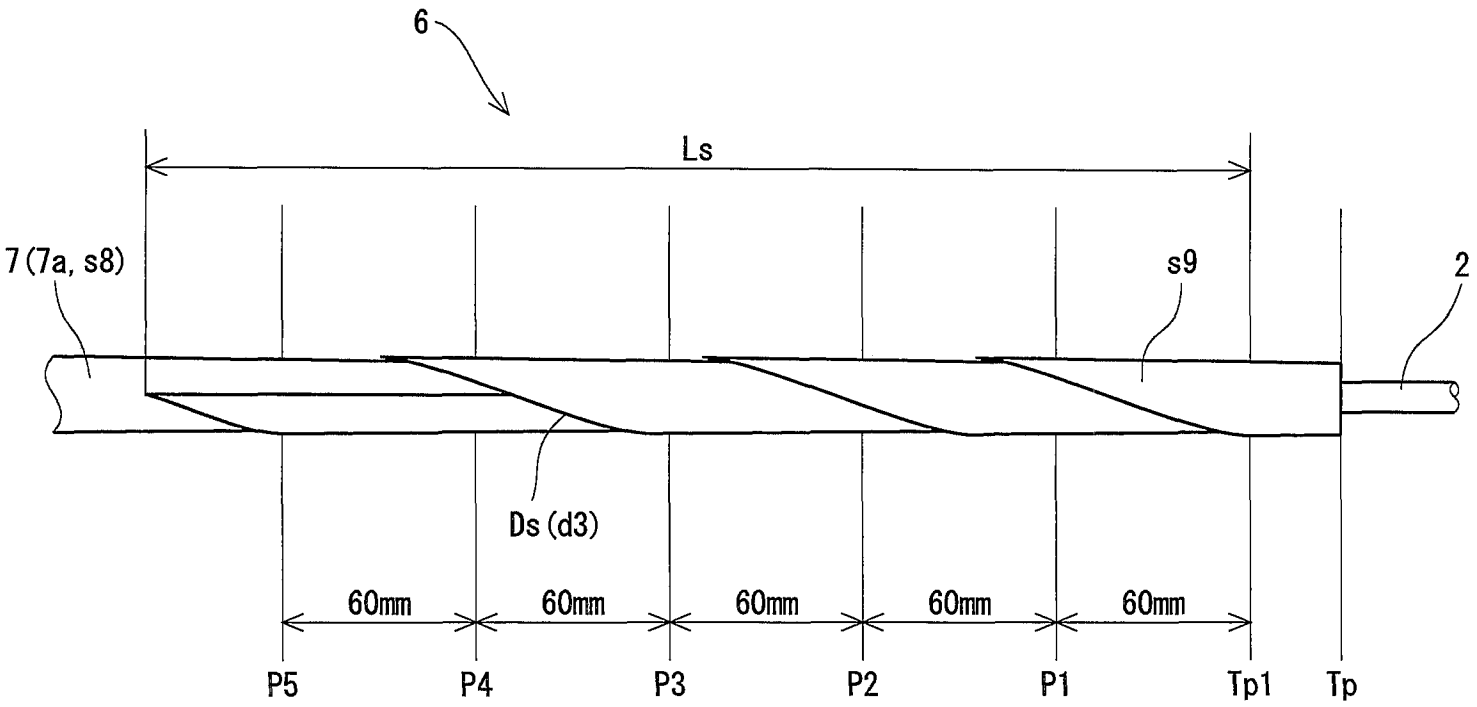
FIG. 4 is a view for explaining positions P1 to P5.

Five positions P1, P2, P3, P4, and P5 are defined in the present invention. These positions are shown in FIG. 4. The position P1 is a position placed apart from the tip Tp1 by 60 mm. The position P2 is a position placed apart from the tip Tp1 by 120 mm. The position P3 is a position placed apart from the tip Tp1 by 180 mm. The position P4 is a position placed apart from the tip Tp1 by 240 mm. The position P5 is a position placed apart from the tip Tp1 by 300 mm. These distances are measured along the axial direction of the shaft.

In the present application, the height h1 of the level difference Ds at the position P1 is defined as h11. The height h1 of the level difference Ds at the position P2 is defined as h12. The height h1 of the level difference Ds at the position P3 is defined as h13. The height h1 of the level difference Ds at the position P4 is defined as h14. The height h1 of the level difference Ds at the position P5 is defined as h15. In respect of enhancing a reinforcing effect produced by the prepreg for the tip reinforcing layer, an average value Ha of the heights h11 to h15 at the five positions is preferably equal to or less than 0.03 mm, more preferably equal to or less than 0.02 mm, and still more preferably equal to or less than 0.01 mm. The average value Ha is calculated by the following formula.

$$Ha=(h11+h12+h13+h14+h15)/5$$

When a length Ls in the axial direction of the shaft of the prepreg for the tip reinforcing layer is short, the level difference Ds may not exist at all of the positions P1 to P5. For example, as in the embodiment of FIG. 5, the level difference Ds may not exist at the position P5, and the level difference Ds may exist at the positions P1 to P4. In this case, the average value Ha is an average value of the four positions. More specifically, in the case of the embodiment of FIG. 5, the average value Ha is calculated by the following formula.

$Ha=(h11+h12+h13+h14)/4$

In respect of enhancing the reinforcing effect produced by the prepreg for the tip reinforcing layer, the height h11 is preferably equal to or less than 0.03 mm, more preferably equal to or less than 0.02 mm, and still more preferably equal to or less than 0.01 mm.

In respect of enhancing the reinforcing effect produced by the prepreg for the tip reinforcing layer, the height h12 is preferably equal to or less than 0.03 mm, more preferably equal to or less than 0.02 mm, and still more preferably equal to or less than 0.01 mm.

In respect of enhancing the reinforcing effect produced by the prepreg for the tip reinforcing layer, the height h13 is preferably equal to or less than 0.03 mm, more preferably equal to or less than 0.02 mm, and still more preferably equal to or less than 0.01 mm.

In respect of enhancing the reinforcing effect produced by the prepreg for the tip reinforcing layer, the height h14 is preferably equal to or less than 0.03 mm, more preferably equal to or less than 0.02 mm, and still more preferably equal to or less than 0.01 mm.

In respect of enhancing the reinforcing effect produced by the prepreg for the tip reinforcing layer, the height h15 is preferably equal to or less than 0.03 mm, more preferably equal to or less than 0.02 mm, and still more preferably equal to or less than 0.01 mm.

In respect of enhancing the reinforcing effect produced by the prepreg for the tip reinforcing layer, a ratio (Ha/Pt) of the average value Ha to the thickness Pt is preferably equal to or less than 0.5, more preferably equal to or less than 0.3, and still more preferably equal to or less than 0.1.

In respect of enhancing the reinforcing effect produced by the prepreg for the tip reinforcing layer, a ratio (h11/Pt) of the height h11 to the thickness Pt is preferably equal to or less than 0.5, more preferably equal to or less than 0.3, and still more preferably equal to or less than 0.1.

In respect of enhancing the reinforcing effect produced by the prepreg for the tip reinforcing layer, a ratio (h12/Pt) of the height h12 to the thickness Pt is preferably equal to or less than 0.5, more preferably equal to or less than 0.3, and still more preferably equal to or less than 0.1.

In respect of enhancing the reinforcing effect produced by the prepreg for the tip reinforcing layer, a ratio (h13/Pt) of the height h13 to the thickness Pt is preferably equal to or less than 0.5, more preferably equal to or less than 0.3, and still more preferably equal to or less than 0.1.

In respect of enhancing the reinforcing effect produced by the prepreg for the tip reinforcing layer, a ratio (h14/Pt) of the height h14 to the thickness Pt is preferably equal to or less than 0.5, more preferably equal to or less than 0.3, and still more preferably equal to or less than 0.1.

In respect of enhancing the reinforcing effect produced by the prepreg for the tip reinforcing layer, a ratio (h15/Pt) of the height h15 to the thickness Pt is preferably equal to or less than 0.5, more preferably equal to or less than 0.3, and still more preferably equal to or less than 0.1.

The thickness Pt of the prepreg for the tip reinforcing layer is set to 0.06 mm or greater and 0.12 mm or less. When the prepreg having the thickness Pt of less than 0.06 mm is used, it is necessary to increase the number of winds in order to secure the strength. When the number of winds is large, productivity is decreased, resulting in an increase of production cost. When the thickness Pt is more than 0.12 mm, the level difference Ds is excessively increased.

At the surface polishing step, the whole surface of the tube stock may be polished, or the surface of the tube stock may be partially polished. Usually, the surface of the tube stock is mostly polished at the polishing step. However, a portion of the surface of the tube stock to which a grip is attached is covered with the grip when a golf club is completed. Therefore, it is unnecessary to polish the portion to which the grip is attached. In respect of eliminating the waste of the polishing step, the portion of the tube stock to which the grip is attached may not be polished.

As described above, the full length outermost layer has the exposure layer exposed to the outer surface of the shaft. When the thickness of the exposure layer before being polished is defined as Qt1 (mm) and the average thickness of the exposure layer after being polished is defined as Qt2 (mm), a ratio (Qt2/Qt1) is preferably considered. The thickness Qt1 is substantially equal to the thickness of the prepreg which constitutes the full length outermost layer. In the embodiment, the thickness Qt1 is substantially equal to the thickness of the prepreg s8. The average thickness Qt2 of the exposure layer after being polished is set to be smaller than thickness Qt1 by the surface polishing. Therefore, the ratio (Qt2/Qt1) is less than 1.0.

When the ratio (Qt2/Qt1) is excessively small, the strength of the shaft may be reduced. When the number of the full length layers is increased in order to suppress a reduction in the strength of the shaft, the manufacturing cost of the shaft is increased. In these respects, the ratio (Qt2/Qt1) is preferably equal to or greater than 0.6, and more preferably equal to or greater than 0.7. In the respect, the ratio (Qt2/Qt1) is also preferably set to a value close to 1.0. However, in respect of making the marks of the wrapping tape inconspicuous, the ratio (Qt2/Qt1) is preferably equal to or less than 0.9.

In respect of the strength of the shaft, the polishing amount of the full length layer is preferably equal to or less than 3 g, and more preferably equal to or less than 2 g. The polishing amount is preferably few. However, in respect of making the marks of the wrapping tape inconspicuous, the polishing amount of the full length layer may be set to be equal to or greater than 1 g.

Next, the surface polishing step used in the present invention will be described.

Figure 6:
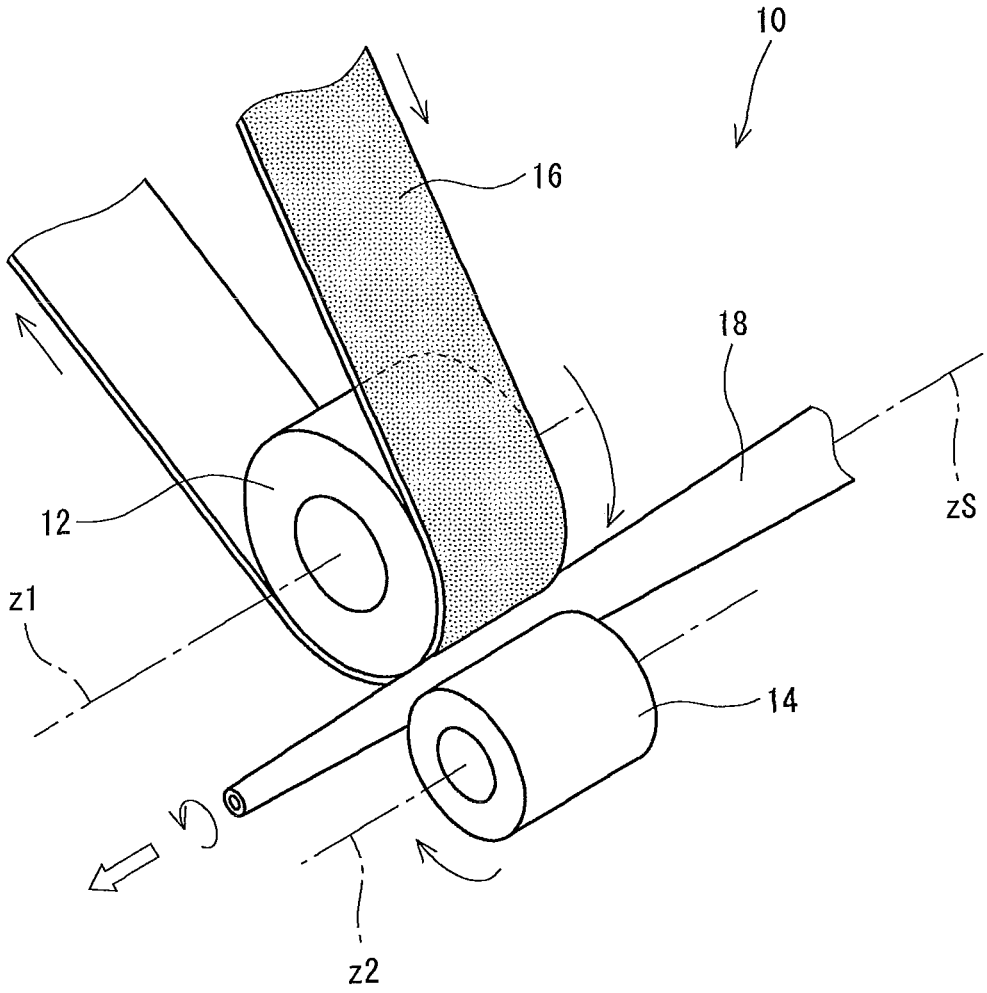
FIG. 6 is a perspective view showing an example of a polishing method of a shaft.
Figure 7:
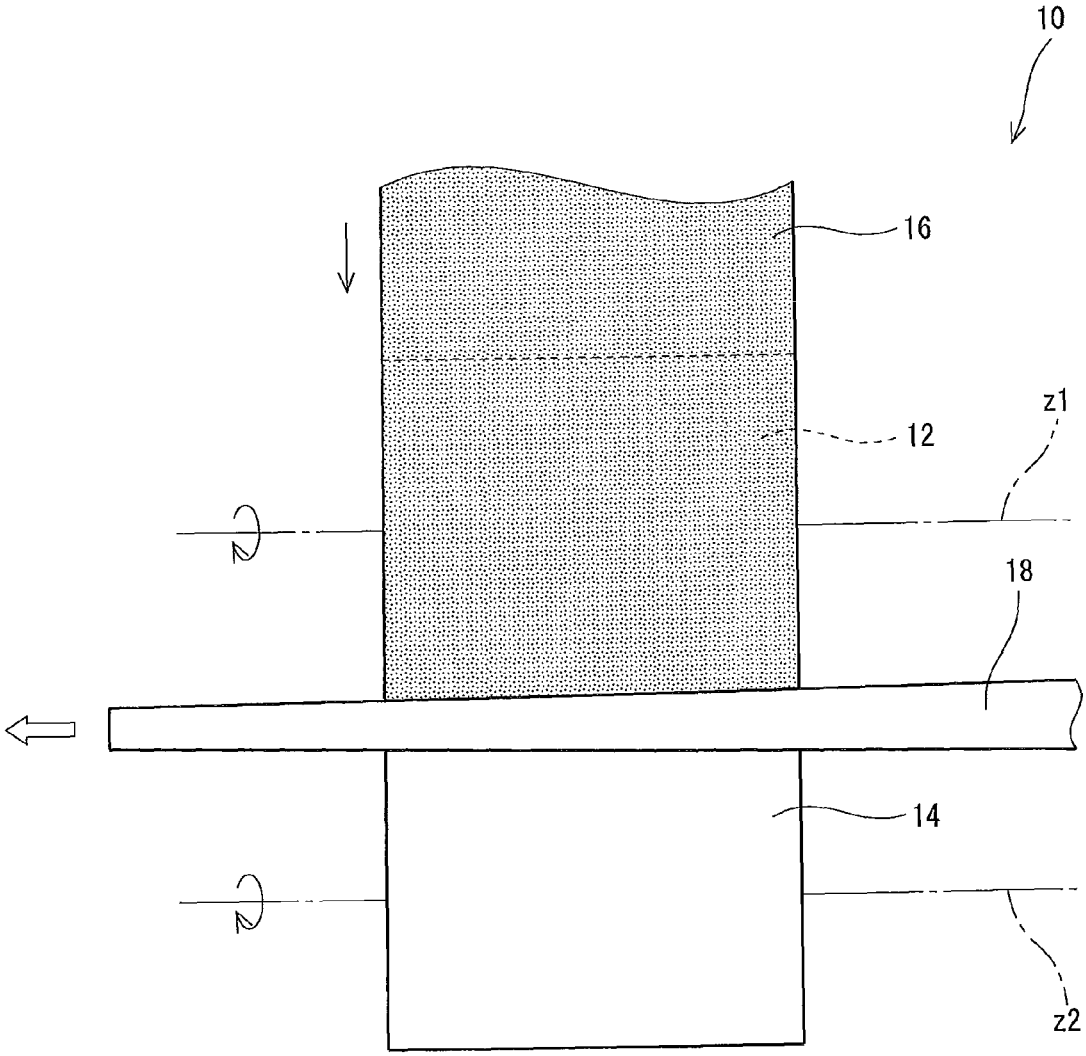
FIG. 7 is a plan view of the embodiment of FIG. 6 from above.

FIG. 6 is a perspective view showing a state of an example of the surface polishing step. FIG. 7 is a plan view showing a state of the surface polishing step. A polishing device 10 used in the surface polishing step is provided with a roller 12, a pressure roller 14, and a polishing body 16.

At the surface polishing step, a tube stock 18 in which both ends are cut is polished.

The polishing body 16 is an endless polishing belt. The polishing belt has a base material and a polishing agent adhering to the surface of the base material. A paper and a cloth are exemplified as the base material. The polishing body 16 may be integrated with the roller 12. For example, the polishing agent may be provided on the surface of the roller 12 itself.

The roller 12 and the pressure roller 14 are disposed at a predetermined interval. A direction of a rotating axis z1 of the roller 12 is almost parallel to a direction of a rotating axis z2 of the pressure roller 14. The polishing body 16 is laid over between the roller 12 and the other roller which is not shown. The polishing body 16 moves together with the surface of the rotating roller 12 to carry out polishing.

The roller 12 and the pressure roller 14 rotate in the same direction. The tube stock 18 rotates in a direction opposite to the roller 12. The tube stock 18 is passed between the roller 12 and the pressure roller 14. The pressure roller 14 applies a set pressure to the tube stock 18. The pressure (polishing pressure) forces the tube stock 18 on the polishing body 16, whereby the tube stock 18 is polished by the polishing body 16. The tube stock 18 moves in an axial direction zS (an open arrow direction of FIG. 6) of the shaft while rotating (rotating on its axis) in the axial direction thereof. The whole outer surface of the shaft is polished by the rotation on its axis and the movement.

As described above, when the polishing step is carried out with a polishing device using a polishing belt, it is preferable that the polishing step includes a first polishing step, and a second polishing step having a particle size of the polishing agent of the belt and/or a feed speed of the belt which are different from those of the first polishing step. More preferably, the particle size of the polishing agent at the second polishing step is preferably finer than the particle size of the polishing agent at the first polishing step. In other words, the count (number following F which is described later and is specified by JIS R6001-1998) of the polishing agent at the second polishing step is preferably greater than the count of the polishing agent at the first polishing step. Such a step can enhance productivity, reduce the height of the level difference Ds, and prevent excessive polishing. Both the first polishing step and the second polishing step can use the polishing device. At least one of the first polishing step and the second polishing step may use the other polishing device. At least one of the first polishing step and the second polishing step may carry out polishing manually.

The polishing agent used for the polishing body is not restricted. A natural polishing agent and an artificial polishing agent are exemplified as the polishing agent.

Garnett, flint, and emery are exemplified as the natural polishing agent. Garnett, which is contained in a volcanic rock, a gravel of a stream bed, or the like, has vitreous luster, and is a hard and brittle mineral substance. Garnett is classified into several kinds based on components. The chemical structural formula of typical garnett is $Al_2O_3.3FeO.3SiO_2$. Garnett is used for a Japanese sandpaper for polishing by hand, and a wood sandpaper. The chemical structural formula of flint is $SiO_2$. Emery is a mineral substance which mainly contains a mixing system of corundum ($Al_2O_3$) and magnetic steel ($Fe_3O_4$). Emery is used for a polishing cloth and a sandpaper, and is preferably used for rust removal and polishing of plating ground.

As the artificial polishing agent, alumina polishing agents such as fused alumina, silicon carbide, and the like are exemplified. The polishing agent of the fused alumina is obtained by fusing and solidifying pure alumina ($Al_2O_3$) in an arc furnace, and by pulverizing and regulating the solidified alumina. The polishing agent of the fused alumina contains impurities and exhibits a brown color. A fused alumina polishing agent having the highest purity is referred to as 4 A (WA), and is hereinafter referred to as 3 A and 2 A in a descending order of purity. The polishing agent made of silicon carbide is one of the polishing agents widely used at present. A lump (ingot) of silicon carbide is manufactured by reacting silica rock with pitch coke at 1800° C. in the electric furnace. The lump is pulverized, and washed. The particle size of the pulverized substance is uniformized to be used as the polishing agent.

The silicon carbide polishing agent has a hardness, a sharp shape and brittle properties. Although the silicon carbide polishing agent has an excellent polishing force, the polishing agent tends to produce a coarse finished face, and is suitable for polishing a hard coating film and boards. On the other hand, clogging is apt to be generated in polishing a soft coating film, and fuzzing is apt to be generated in polishing wooden basis.

Although the alumina polishing agent has a hardness slightly poorer than that of the silicon carbide polishing agent, the alumina polishing agent has a brittleness less than that of the silicon carbide polishing agent. The alumina polishing agent has particles having a comparatively obtuse angle and shallow cutting. When the alumina polishing agent polishes the hard coating film, a slide is apt to occur. Although the alumina polishing agent has a small polishing force, the alumina polishing agent tends to produce a fine finished face to increase a smoothness degree. When the alumina polishing agent polishes the soft coating film, the alumina polishing agent produces less clogging and has an excellent polishing resistance.

The particle size of the polishing agent is not restricted. It is preferable that the particle size of the polishing agent at the first polishing step is coarser than the particle size of the polishing agent at the second polishing step in respects of enhancement in productivity, enhancement in a strength, and a good appearance at the polishing step.

The particle size of the polishing agent shown later is a particle size specified in JIS R6001-1998.

In respects of enhancing the productivity, suppressing the level difference Ds, and suppressing the excessive polishing, the particle size of the polishing agent at the surface polishing step is preferably equal to or greater than F220, more preferably equal to or greater than F240, and still more preferably equal to or greater than F280. For the upper limit, the particle size is equal to or less than F800, preferably equal to or less than F700, and particularly preferably equal to or less than F600.

In respect of reducing the irregularities caused by polishing to enhance the strength of the shaft, the particle size of the polishing agent at the first polishing step is preferably equal to or greater than F220, more preferably equal to or greater than F240, and still more preferably equal to or greater than F280. In respect of the productivity of the polishing step, the particle size of the polishing agent at the first polishing step is preferably equal to or less than F600, more preferably equal to or less than F500, and still more preferably equal to or less than F400.

In respect of reducing the irregularities caused by polishing to enhance the strength of the shaft, the particle size of the polishing agent at the second polishing step is preferably equal to or greater than F320, more preferably equal to or greater than F360, still more preferably equal to or greater than F400, and particularly preferably equal to or greater than F500. In respect of the productivity of the polishing step, the particle size of the polishing agent at the second polishing step is preferably equal to or less than F800, more preferably equal to or less than F700, and still more preferably equal to or less than F600.

Figure 5:
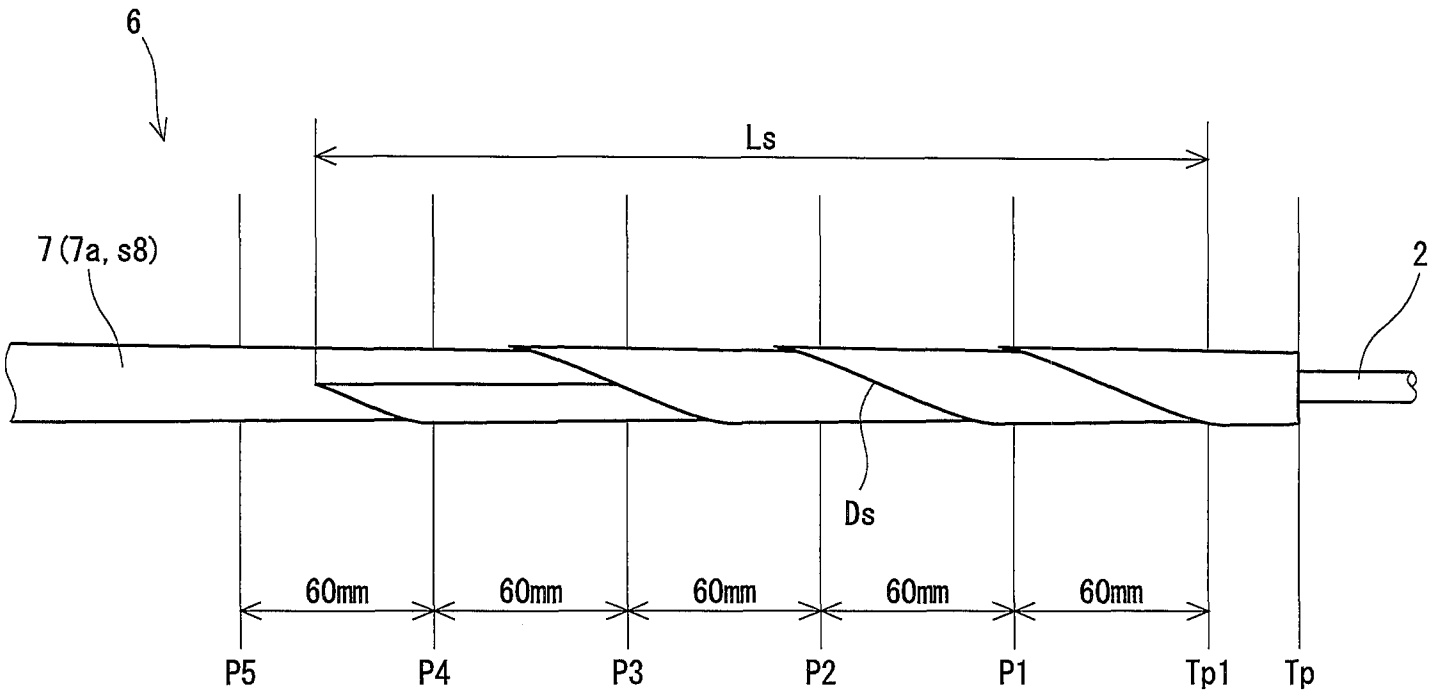
FIG. 5 is a view for explaining positions P1 to P5 in an embodiment different from that of FIG. 4.

A length in the axial direction of the tip reinforcing layer is shown by a double pointed arrow Ls in FIGS. 4 and 5. The length Ls is measured along a central axis zS of the shaft. The length Ls is not restricted.

In respect of enhancing the strength of the tip part of the shaft, the length Ls in the axial direction of the tip reinforcing layer is preferably equal to or greater than 150 mm, and more preferably equal to or greater than 180 mm. In respect of lightweight of the shaft, the length Ls is preferably equal to or less than 400 mm, and more preferably equal to or less than 300 mm.

The feed speed of the shaft in polishing is not restricted. The feed speed is a movement speed of the shaft in the direction of the axis zS of the shaft.

In respects of suppressing an excessive polishing amount and of shortening a polishing time, a feed speed V1 at the first polishing step is preferably equal to or greater than 20 mm/s, more preferably equal to or greater than 30 mm/s, and still more preferably equal to or greater than 50 mm/s. Similarly, a feed speed V2 at the second polishing step is preferably equal to or greater than 20 mm/s, more preferably equal to or greater than 30 mm/s, and still more preferably equal to or greater than 50 mm/s. In respects of suppressing variation in a height of the level difference Ds and of suppressing under-polishing, the feed speed V1 at the first polishing step is preferably equal to or less than 300 mm/s, more preferably equal to or less than 200 mm/s, and still more preferably equal to or less than 150 mm/s. Similarly, the feed speed V2 at the second polishing step is preferably equal to or less than 300 mm/s, more preferably equal to or less than 200 mm/s, and still more preferably equal to or less than 150 mm/s.

While the full length of the shaft is polished at the surface polishing step, the feed speed may be changed. When a polishing speed in polishing the tip Tp1 to a position Px is defined as Vx, and a polishing speed in polishing the position Px to the butt Bt1 is defined as Vy, in respect of enhancing productivity while suppressing variation in the level difference Ds in the tip part of the shaft, Vy is preferably greater than Vx, and a ratio (Vy/Vx) is preferably equal to or greater than 1.5, and more preferably greater than 1.5.

Particularly, as described above, when the polishing step includes the first polishing step and the second polishing step, Vy is preferably greater than Vx at the first polishing step. The ratio (Vy/Vx) is preferably equal to or greater than 1.5, and more preferably greater than 1.5 at the first polishing step.

A distance between the tip Tp1 and the position Px is defined as Lc (mm). In respects of the productivity of the polishing step and of the suppression of the level difference Ds, an absolute value of a difference (Lc−Ls) between the distance Lc and the length Ls (mm) is preferably smaller. In respect of suppressing the level difference Ds on a butt side of the tip reinforcing layer, the difference (Lc−Ls) is preferably equal to or greater than −200, more preferably equal to or greater than −150, and still more preferably equal to or greater than −100. In respect of the productivity of the polishing step, the difference (Lc−Ls) is preferably equal to or less than 200, more preferably equal to or less than 150, still more preferably equal to or less than 100, and particularly preferably equal to or less than 50. In respect of the suppression of the level difference Ds, the distance Lc is preferably equal to or greater than 100 mm, and more preferably equal to or greater than 200 mm. The distance Lc is measured along the central axis zS of the shaft.

In respect of lengthening the length of the golf club to enhance a head speed, the full length of the shaft is preferably equal to or greater than 1143 mm, more preferably equal to or greater than 1155 mm, and still more preferably equal to or greater than 1168 mm. For the upper limit of the full length of the shaft, the full length is preferably equal to or less than 1499 mm, and more preferably equal to or less than 1473 mm.

A weight of the shaft is not restricted. A lightweight shaft tends to have a tip part having a thin thickness. Therefore, the present invention is effective for the lightweight shaft. In the respect, the weight of the shaft is preferably equal to or less than 60 g, more preferably equal to or less than 55 g, and still more preferably equal to or less than 50 g.

The fiber contained in the prepreg is not restricted. Examples of the fiber include an inorganic fiber, an organic fiber, and a metal fiber. Examples of the inorganic fiber include a carbon fiber, a glass fiber, a boron fiber, a silicon carbide fiber, and an alumina fiber. Examples of the organic fiber include a polyethylene fiber and a polyamide fiber. As described above, the carbon fiber is preferred. A plurality of fibers may be combined. In respects of a rigidity and a small weight, a tensile modulus of elasticity of a fiber is preferably equal to or higher than 5 t/mm$^2$, more preferably equal to or higher than 10 t/mm$^2$, and still more preferably equal to or higher than 24 t/mm$^2$. In respect of an availability of the fiber, it is preferable that the tensile modulus of elasticity of the fiber is equal to or less than 100 t/mm$^2$. The tensile modulus of elasticity is measured in accordance with JIS R7601: 1986 "Testing Methods for Carbon Fibers".

EXAMPLES

Hereinafter, although the advantages of the present invention will be apparent from examples, the present invention should not be construed restrictively based on description of the examples.

First of all, a valuation method will be described.

Fatigue Test

A portion of a shaft on a butt side than a position placed apart from a tip Tp1 by 870 mm was fixed, and a position placed apart from the tip Tp1 by 150 mm was reciprocated with an amplitude of 260 mm. A portion of a level difference Ds of the surface of the shaft was visually confirmed at every number of times of reciprocation of 5000. The number of times of reciprocation when abnormalities (cracking or peeling) are discovered on the portion of the level difference Ds is shown in the following Table 1. Shafts in which abnormalities are not discovered when the number of times of reciprocation of 100,000 is reached are indicated as "100000" in the following Table 1.

Appearance Evaluation

Appearance evaluation of the portion of the level difference Ds after a polishing step is shown in the following Table 1. Evaluation was visually carried out in three stages based on the following standards. Good is the best evaluation. Poor is the worst evaluation.

Good: The level difference Ds is inconspicuous.
Average: The level difference Ds is slightly conspicuous.
Poor: The level difference Ds is conspicuous.

Example 1

Figure 8:
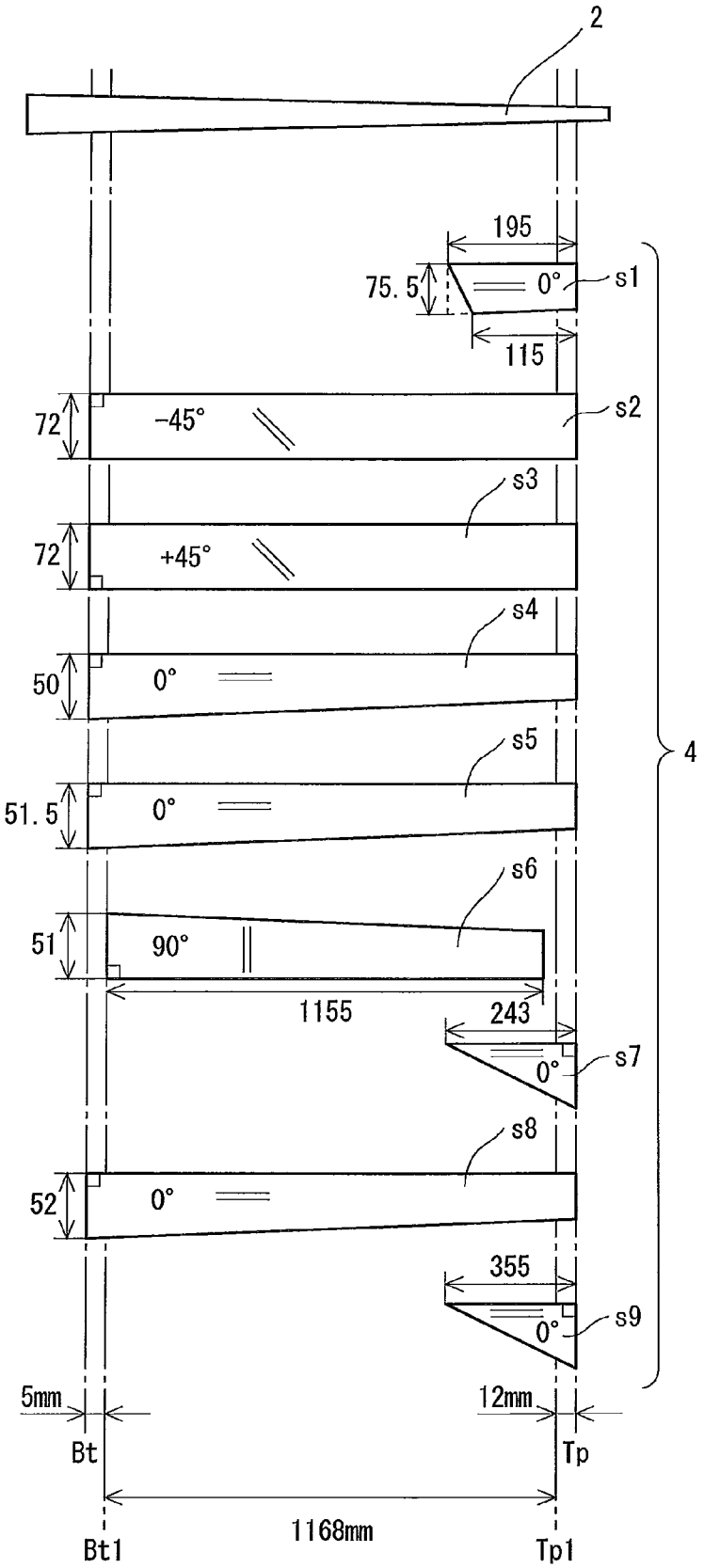
FIG. 8 is a view showing a prepreg constitution of examples and comparative example.

As shown in FIG. 8, prepreg sheets s1 to s9 were sequentially wound around a mandrel 2. A manufacturing method was the same as that of the embodiment. A lubricant was applied onto the mandrel 2, and the nine prepregs were then wound around the mandrel to obtain an intermediate formed body. A prepreg for a tip reinforcing layer is the prepreg s9. An angle shown in FIG. 8 indicates an orientation angle of a carbon fiber with respect to an axial direction of a shaft. In each of the prepregs, an epoxy resin is used for a matrix resin.

"MR350C-125S" (trade name) was used for the sheet s1. "HRX350C-075S" (trade name) was used for the sheets s2 and s3. "MR350C-100S" (trade name) was used for the sheet s4. "MR350C-125S" (trade name) was used for the sheet s5. "805S-3 (trade name)" was used for the sheet s6. "TR350C-175S" (trade name) was used for the sheet s7. "TR350C-150S" (trade name) was used for the sheet s8. "TR350C-125S" (trade name) was used for the sheet s9. "805S-3" (trade name) is manufactured by Toray Industries, Inc. The others are manufactured by MITSUBISHI RAYON CO., LTD. A thickness of "TR350C-125S" is 0.103 mm. The thickness is equivalent to a thickness Pt in the present application. The size of each of the sheets is shown in FIG. 8 (unit: mm).

Next, there was executed a tape winding step of winding a wrapping tape around an outer peripheral surface of the intermediate formed body. The tape winding step was carried out with a wrapping machine manufactured by YOKOTE TEKKOSHO. After the tape winding step, a curing step (heating step) was carried out. Next, the mandrel 2 was pulled out. Subsequently, the wrapping tape was removed to obtain a tube stock. Both ends of the tube stock were cut. A tip part of 12 mm was cut, and a back end part of 5 mm was cut. The both ends were cut to set the full length of the shaft to 1168 mm. A length Ls in an axial direction of the tip reinforcing layer is 343 mm.

Next, a first polishing step was carried out. An endless polishing paper was used for a polishing body of the first polishing step. The particle size of a polishing agent was set to F400. A polishing pressure was set to 1 kgf/cm$^2$. As for a feed speed V1, a feed speed Vx from a tip Tp1 to a position P5 (a position placed apart from a tip Tp1 by 300 mm) was set to 150 mm/s, and a feed speed Vy from the position P5 to a butt Bt1 was set to 150 mm/s. Thus, at the surface polishing step, the distance Lc was set to 300 mm.

Next, a second polishing step was carried out. An endless polishing paper was used for a polishing body of the second polishing step. The particle size of a polishing agent was set to F600. A polishing pressure was set to 1 kgf/cm$^2$. As for a feed speed V2, a feed speed Vx from the tip Tp1 to the position P5 was set to 150 mm/s, and a feed speed Vy from the position P5 to the butt Bt1 was set to 150 mm/s. Thus, at the second polishing step, the distance Lc was set to 300 mm. Through the above, a shaft of Example 1 was obtained.

Examples 2 to 5

Shafts of Examples 2 to 5 were obtained in the same manner as in Example 1 except for matters shown in Table 1. The specifications and evaluation results of the shafts are shown in the following Table 1.

Comparative Example 1

The second polishing step was not carried out in Comparative Example 1. A shaft of Comparative Example 1 was obtained in the same manner as in Example 1 except for the matters shown in Table 1. The specification and evaluation result of the shaft are shown in the following Table 1.

TABLE 1

Specifications and Evaluation Results of Examples and Comparative Example

| | | | Comparative Example 1 | | Example 1 | | Example 2 | | Example 3 | | Example 4 | | Example 5 | |
|---|---|---|---|---|---|---|---|---|---|---|---|---|---|---|
| | | Unit | Tip Tp1 to position P5 (Vx) | Position P5 to butt Bt1 (Vy) | Tip Tp1 to position P5 (Vx) | Position P5 to butt Bt1 (Vy) | Tip Tp1 to position P5 (Vx) | Position P5 to butt Bt1 (Vy) | Tip Tp1 to position P5 (Vx) | Position P5 to butt Bt1 (Vy) | Tip Tp1 to position P5 (Vx) | Position P5 to butt Bt1 (Vy) | Tip Tp1 to position P5 (Vx) | Position P5 to butt Bt1 (Vy) |
| Coarse polishing (First polishing step) | Particle size of polishing agent | | 400 | | 400 | | 400 | | 400 | | 400 | | 400 | |
| | Polishing pressure | kgf/cm$^2$ | 1 | | 1 | | 1 | | 1 | | 1 | | 1 | |
| | Feed speed V1 | mm/sec | 150 | 150 | 150 | 150 | 100 | 150 | 75 | 150 | 60 | 150 | 50 | 150 |
| | Rotating speed of roller | rpm | 1500 | | 1500 | | 1500 | | 1500 | | 1500 | | 1500 | |
| Final polishing (Second polishing step) | Particle size of polishing agent | | — | | 600 | | 600 | | 600 | | 600 | | 600 | |
| | Polishing pressure | kgf/cm$^2$ | — | | 1 | | 1 | | 1 | | 1 | | 1 | |
| | Feed speed V2 | mm/sec | — | | 150 | 150 | 150 | 150 | 150 | 150 | 150 | 150 | 150 | 150 |
| | Rotating speed of roller | rpm | — | | 1500 | | 1500 | | 1500 | | 1500 | | 1500 | |
| Average value Ha | | mm | 0.055 | | 0.046 | | 0.023 | | 0.012 | | 0.008 | | 0.002 | |
| Thickness Pt | | mm | 0.103 | | 0.103 | | 0.103 | | 0.103 | | 0.103 | | 0.103 | |
| Ha/Pt | | | 0.53 | | 0.45 | | 0.22 | | 0.12 | | 0.08 | | 0.02 | |
| Length Ls in axial direction of tip reinforcing layer | | mm | 343 | | 343 | | 343 | | 343 | | 343 | | 343 | |
| Number of winds of tip reinforcing layer at tip Tp | | Layer | 6 | | 6 | | 6 | | 6 | | 6 | | 6 | |
| Weight of shaft | | g | 45.3 | | 44.1 | | 43.8 | | 43.2 | | 42.7 | | 42.2 | |
| Full length of shaft | | mm | 1168 | | 1168 | | 1168 | | 1168 | | 1168 | | 1168 | |
| Fatigue test | | Number of times | 45000 | | 82000 | | 100000 | | 100000 | | 100000 | | 100000 | |
| Appearance evaluation | | | poor | | average | | good | | good | | good | | good | |

Thus, the evaluation in each of the examples is higher than that in the comparative example. From the evaluation results, advantages of the present invention are apparent.

The present invention can be applied to all golf club shafts.

The above description is only illustrative and various changes can be made without departing from the scope of the present invention.

What is claimed is:

1. A golf club shaft formed by curing a wound prepreg, the golf club shaft comprising:

a main body layer having a full length layer provided over a full length of the shaft, wherein when a layer positioned on the outermost side in the full length layer is defined as a full length outermost layer, the full length outermost layer has an exposure layer exposed to an outer surface of the shaft; and a tip reinforcing layer provided on an outermost layer, wherein a prepreg for the tip reinforcing layer has a portion having a larger circumferential direction width toward a tip side and the prepreg for the tip reinforcing layer has a thickness Pt of 0.06 mm or greater and 0.12 mm or less and an edge of the tip reinforcing layer extends spirally, wherein the golf club shaft is subjected to surface polishing so that a height h1 of a level difference formed by the edge of the tip reinforcing layer satisfies the following item (a):

(a) when the height h1 at a position placed apart from a tip by 60 mm is defined as h11; the height h1 at a position placed apart from the tip by 120 mm is defined as h12; the height h1 at a position placed apart from the tip by 180 mm is defined as h13; the height h1 at a position placed apart from the tip by 240 mm is defined as h14; and the height h1 at a position placed apart from the tip by 300 mm is defined as h15, an average value Ha of the heights h11 to h15 at the five positions is equal to or less than 0.03 mm, and wherein, when a thickness of said exposure layer on the shaft before the surface polishing is defined as Qt1 (mm) and an average thickness of the exposure layer after the surface polishing is defined as Qt2 (mm), a ratio (Qt2/Qt1) is equal to or greater than 0.6.

2. The golf club shaft according to claim 1, wherein the golf club shaft is subjected to the surface polishing so that the height h1 satisfies the following item (b):

(b) a ratio (Ha/Pt) is equal to or less than 0.5.

3. A method for making a golf club shaft according to claim 1, comprising surface polishing a golf club shaft with a polishing agent having a particle size which is equal to or greater than F220 and equal to or less than F800.

4. The method for making a golf club shaft according to claim 3, wherein the polishing is carried out with a polishing device using a polishing belt, the polishing includes a first polishing step, and a second polishing step having a particle size of a polishing agent of the belt and/or a feed speed of the belt which are different from those of the first polishing step.

5. The method for making a golf club shaft according to claim 4, wherein the particle size of the polishing agent at the first polishing step is coarser than the particle size of the polishing agent at the second polishing step.

6. The method for making a golf club shaft according to claim 5, wherein the particle size of the polishing agent at the second polishing step is equal to or greater than F320 and equal to or less than F800.

7. The method for making a golf club shaft according to claim 4, wherein the feed speed is changed while a full length of the shaft is polished, at the first polishing step or the second polishing step.

8. The method for making a golf club shaft according to claim 7, wherein Vy is greater than Vx when a polishing speed in polishing the tip to a position Px is defined as Vx and a polishing speed in polishing the position Px to a butt is defined as Vy.

9. The method for making a golf club shaft according to claim 8, wherein a distance between the tip and the position Px is defined as Lc (mm) and a length in the axial direction of the tip reinforcing layer is defined as Ls (mm), a difference (Lc−Ls) is equal to or greater than −200 and equal to or less than 200.

10. The method for making a golf club shaft according to claim 8, wherein Vy is greater than Vx at the first polishing step.

11. The method for making a golf club shaft according to claim 10, wherein a distance between the tip and the position Px is defined as Lc (mm) and a length in the axial direction of the tip reinforcing layer is defined as Ls (mm), a difference (Lc−Ls) is equal to or greater than −200 and equal to or less than 200.

12. The golf club shaft according to claim 1, wherein a length Ls in the axial direction of the tip reinforcing layer is equal to or greater than 150 mm and equal to or less than 400 mm.

13. The golf club shaft according to claim 1, wherein a full length of the shaft is equal to or greater than 1143 mm and equal to or less than 1499 mm.

14. The golf club shaft according to claim 1, wherein a polishing amount of the full length layer is equal to or greater than 1 g and equal to or less than 3 g.

15. A golf club shaft formed by curing a wound prepreg, the golf club shaft comprising:

a main body layer having a full length layer provided over a full length of the shaft, wherein when a layer positioned on the outermost side in the full length layer is defined as a full length outermost layer, the full length outermost layer has an exposure layer exposed to an outer surface of the shaft; and a tip reinforcing layer provided on an outermost layer, wherein a prepreg for the tip reinforcing layer has a portion having a larger circumferential direction width toward a tip side and the prepreg for the tip reinforcing layer has a thickness Pt of 0.06 mm or greater and 0.12 mm or less and an edge of the tip reinforcing layer extends spirally, wherein the golf club shaft is subjected to surface polishing so that a height h1 of a level difference formed by the edge of the tip reinforcing layer satisfies the following item (b):

(b) when the height h1 at a position placed apart from a tip by 60 mm is defined as h11; the height h1 at a position placed apart from the tip by 120 mm is defined as h12; the height h1 at a position placed apart from the tip by 180 mm is defined as h13; the height h1 at a position placed apart from the tip by 240 mm is defined as h14; the height h1 at a position placed apart from the tip by 300 mm is defined as h15; and an average value of the heights h11 to h15 at the five positions is defined as Ha, a ratio (Ha/Pt) is equal to or lower than 0.5, and wherein, when a thickness of said exposure layer on the shaft before the surface polishing is defined as Qt1 (mm) and an average thickness of the exposure layer after the surface polishing is defined as Qt2 (mm), a ratio (Qt2/Qt1) is equal to or greater than 0.6.

16. The golf club shaft according to claim 15, wherein a polishing amount of the full length layer is equal to or greater than 1 g and equal to or less than 3 g.

17. A method for making a club shaft according to claim 15, comprising surface polishing a golf club shaft with a polishing agent having a particle size which is equal to or greater than F220 and equal to or less than F800.

* * * * *